US009849500B2

(12) United States Patent
Presset et al.

(10) Patent No.: US 9,849,500 B2
(45) Date of Patent: Dec. 26, 2017

(54) CAN MANUFACTURE

(75) Inventors: Alain Presset, St. Gilles (FR); Keith Alan Vincent, Wiltshire (GB); Stuart Alexander Monro, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 802 days.

(21) Appl. No.: 14/236,078

(22) PCT Filed: Jul. 24, 2012

(86) PCT No.: PCT/EP2012/064530

§ 371 (c)(1),
(2), (4) Date: Jan. 30, 2014

(87) PCT Pub. No.: WO2013/017485

PCT Pub. Date: Feb. 7, 2013

(65) Prior Publication Data

US 2014/0161566 A1 Jun. 12, 2014

(30) Foreign Application Priority Data

Aug. 1, 2011 (EP) ..... 11176206

(51) Int. Cl.
*B21D 51/26* (2006.01)
*B21D 22/24* (2006.01)
*B21D 22/28* (2006.01)

(52) U.S. Cl.
CPC ..... *B21D 51/26* (2013.01); *B21D 22/24* (2013.01); *B21D 22/28* (2013.01)

(58) Field of Classification Search
CPC ..... B21D 1/26; B21D 22/20; B21D 22/22; B21D 22/26; B21D 22/28; B21D 22/24; B21D 22/283; B21D 24/04; B21D 24/08; B21D 24/06
See application file for complete search history.

(56) References Cited

U.S. PATENT DOCUMENTS 4,095,544 A 6/1978 Peters et al.
4,790,169 A * 12/1988 Johansson ..... B21D 22/30 72/348
6,505,492 B2 * 1/2003 Jroski ..... B21D 22/20 72/348
8,313,003 B2 * 11/2012 Riley ..... B65D 1/165 220/604

(Continued)

FOREIGN PATENT DOCUMENTS

CN 86102658 A 10/1987
CN 1289274 A 3/2001

(Continued)

*Primary Examiner* — R. K. Arundale
*Assistant Examiner* — Pradeep C Battula
(74) *Attorney, Agent, or Firm* — Baker & Hostetler LLP

(57) ABSTRACT

A method for manufacture of a metal can body is described in which two or more stretching operations are used so as to reduce the thickness of the central part of a cup base, prior to drawing the cup sidewall and forming a can body. By using two or more stretching operations, it has been found possible to control the thickness of the base without significantly reducing pressure performance of the finished can. Alternative embodiments of apparatus comprising tooling for carrying out this method are also described.

12 Claims, 9 Drawing Sheets

(56) References Cited

U.S. PATENT DOCUMENTS

| | | | | |
|---|---|---|---|---|
| 9,174,262 | B2 * | 11/2015 | Monro ..... | B21D 22/20 |
| 2002/0074867 | A1 | 6/2002 | Matsuura et al. | |
| 2007/0175258 | A1 | 8/2007 | Bowen | |

FOREIGN PATENT DOCUMENTS

| | | | |
|---|---|---|---|
| JP | H05-7944 | A | 1/1993 |
| JP | 2002-46931 | A | 2/2002 |
| WO | WO 02/45882 | A1 | 6/2002 |
| WO | WO 2011/095595 | A1 | 8/2011 |

* cited by examiner

CAN MANUFACTURE

CROSS-REFERENCE TO RELATED APPLICATIONS

This application is the National Stage of International Application No. PCT/EP2012/064530 filed Jul. 24, 2012, which claims the benefit of EP application number 11176206.8, filed Aug. 1, 2011, the disclosures of which are incorporated herein by reference in their entirety.

TECHNICAL FIELD

This invention relates to the production of metal cups and in particular (but not exclusively) to metal cups suitable for the production of "two-piece" metal containers or can bodies.

BACKGROUND ART

U.S. Pat. No. 4,095,544 (NATIONAL STEEL CORPORATION) 20 Jun. 1978 details conventional Draw & Wall Ironing (DWI) and Draw & Re-Draw (DRD) processes for manufacturing can bodies from cup-sections for use in making two-piece metal containers. [Note that in the United States of America, DWI is instead commonly referred to as D&I]. The term "two-piece" refers to i) the can body and ii) the closure that would be subsequently fastened to the open end of the filled can body to form the container.

In a DWI (D&I) process (as illustrated in FIGS. 6 to 10 of U.S. Pat. No. 4,095,544), a flat (typically) circular blank stamped out from a roll of metal sheet is drawn through a drawing die, under the action of a punch, to form a shallow first stage cup. This initial drawing stage does not result in any intentional thinning of the blank. Thereafter, the cup, which is typically mounted on the end face of a close fitting punch or ram, is pushed through one or more annular wall-ironing dies for the purpose of effecting a reduction in thickness of the sidewall of the cup, thereby resulting in an elongation in the sidewall of the cup and forming a can body. By itself, the ironing process will not result in any change in the nominal diameter of the first stage cup.

FIG. 1 shows the distribution of metal in a container (or "can") body resulting from a conventional DWI (D&I) process. FIG. 1 is illustrative only, and is not intended to be precisely to scale. Three regions are indicated in FIG. 1:

- Region 1 represents the un-ironed material of the base 1. This remains approximately the same thickness as the ingoing gauge of the blank, i.e. it is not affected by the separate manufacturing operations of a conventional DWI process.
- Region 2 represents the ironed mid-section 2 of the sidewall. Its thickness (and thereby the amount of ironing required) is determined by the performance required for the container body.
- Region 3 represents the ironed top-section 3 of the sidewall. Typically in can making, this ironed top-section is around 50-75% of the thickness of the ingoing gauge.

In a DRD process (as illustrated in FIGS. 1 to 5 of U.S. Pat. No. 4,095,544), the same drawing technique is used to form the first stage cup. However, rather than employing an ironing process, the first stage cup is then subjected to one or more re-drawing operations which act to progressively reduce the diameter of the cup and thereby elongate the sidewall of the cup. By themselves, most conventional re-drawing operations are not intended to result in any change in thickness of the cup material. However, taking the example of container bodies manufactured from a typical DRD process, in practice there is typically some thickening at the top of the finished container body (of the order of 10% or more). This thickening is a natural effect of the re-drawing process and is explained by the compressive effect on the material when re-drawing from a cup of large diameter to one of smaller diameter.

Note that there are alternative known DRD processes which achieve a thickness reduction in the sidewall of the cup through use of small or compound radii draw dies to thin the sidewall by stretching in the draw and re-draw stages.

Alternatively, a combination of ironing and re-drawing may be used on the first stage cup, which thereby reduces both the cup's diameter and sidewall thickness. For example, in the field of the manufacture of two-piece metal containers (cans), the container body is typically made by drawing a blank into a first stage cup and subjecting the cup to a number of re-drawing operations until arriving at a container body of the desired nominal diameter, then followed by ironing the sidewall to provide the desired sidewall thickness and height.

However, DWI (D&I) and DRD processes employed on a large commercial scale have a serious limitation in that they do not act to reduce the thickness (and therefore weight) of material in the base of the cup. In particular, drawing does not result in reduction in thickness of the object being drawn, and ironing only acts on the sidewall of the can body. Essentially, for known DWI (D&I) and DRD processes for the manufacture of can bodies for two-piece containers, the thickness of the base remains broadly unchanged from that of the ingoing gauge of the blank. This can result in the base being far thicker than is required for performance purposes.

The metal packaging industry is fiercely competitive, with weight reduction being a primary objective because it reduces transportation and raw material costs. Typically, containers such as cans for packaging food or beverage products are formed from a coil of single reduced steel of less than 0.35 mm thickness. By way of example, around 65% of the costs of manufacturing a typical two-piece metal food container with side walls ironed to 0.127 mm (0.005" (5 thou)) derive from raw material costs.

There is therefore a need for improved light-weighting of metal cup-sections in a cost-effective manner.

Unpublished patent application PCT/EP11/051666 in the name of Crown Packaging Technology, Inc. describes a method of manufacture of a can body which uses a stretching operation to achieve a base which is thinner than the ingoing gauge of the metal sheet prior to stretching, without requiring loss or waste of metal. The present application is in the name of the same Applicant and represents an improvement of the invention of that unpublished application which relates to improving the effectiveness of the stretching process by completing it in two or more separate stretching stages. The improvement of the present invention increases stretch in previously unstretched and/or under-stretched portions of the cup-sections.

Note that in this document, the terms "cup-section" and "cup" are used interchangeably. Furthermore, the term "container" and "can" are often used to refer to the same product.

SUMMARY OF INVENTION

According to the present invention, there is provided a method for manufacture of a metal can body, the method comprising the following stages: i) a first stretching stage comprising: taking a cup having a sidewall and an integral base, the cup being formed of metal sheet, clamping an annular region on the base to define an enclosed portion which includes a central part of the base, and deforming and stretching at least some of that enclosed portion to thereby increase the surface area and reduce the thickness of the base; ii) a second stretching stage comprising: stretching a further enclosed part of the base, which may include the same or a different area from the first enclosed portion and which includes the central part of the base; in which the annular clamping operation is adapted to restrict or prevent metal flow from radially outside the clamped region into the enclosed portion during stretching; and iii) a drawing operation comprising drawing the cup into a can body by pulling and transferring material outwardly from the stretched and thinned base.

In the packaging industry, in which cans for the packaging of both food and beverage products are manufactured, it is considered essential to use lightweight material, for example less than 0.35 mm thickness for single reduced steel.

Typically, the second stretching operation comprises clamping a second annular region of the base to define a second enclosed portion which defines a different area from the first enclosed portion but which includes the central part of the base; and deforming and stretching at least some of the second enclosed area, to reduce the thickness of the base still further; in which the annular clamping operations are adapted to restrict or prevent metal flow from radially outside the clamped regions into the enclosed portion during stretching.

The method of the present invention focuses further on the region of least amount of stretch (i.e. percentage thinning) in the broadly spherical stretching method of unpublished patent application PCT/EP11/051666, which is at the centre of the base of the cup.

The method of the present invention is directed at increasing the level of stretch in this area of the cup still further for a number of reasons:

- This area is at the centre of the finished can, and normally is not a performance critical area. The metal thickness therefore is also not critical, and the further stretching of the cup base achieved in the present invention gives the benefit of further reduction of the metal content in the can, without significantly reduced pressure performance.
- By using an additional stretching of the centre part of the cup, as opposed to the periphery of the stretched area in the cup base, when the cup is redrawn in the bodymaker, a greater amount of metal is transferred into the body wall. This is because the periphery of the cup base is thicker, and a greater volume of metal is transferred for a given area.
- By using two or more stretching operations, it has been found to be possible to control base thickness still further.

In a first embodiment, the first stretching operation stretches only a first enclosed portion which is the central portion of the cup base, typically into a domed profile. The second stretching operation of this embodiment may provide a stretch punch having a larger diameter and deeper profile than that used for the first operation. The second operation may include supporting the dome formed in the first stretching operation whilst forming the outer portion of the dome. Thus the second enclosed portion may have a larger area than the first enclosed portion. By working specifically on the central portion of the cup in the first stretching operation, there is increased stretching material in this region, as compared to the single operation process of PCT/EP11/051666.

In another embodiment, the first stretching operation may include stretching substantially all the base of the cup, and forming a first stretched profile with a large diameter and flat central portion. This embodiment includes clamping of a second annular region by clamping only that central portion of the base. In other words, the step of clamping of a second annular region comprises clamping a second annular region, defining a second enclosed portion, which comprises substantially only a central part of the base. The two stretching operations of this embodiment are completely independent of each other.

In a third method of this invention, the second stretching operation may comprise a reverse stretching of a central part of the base. The corresponding apparatus used for this embodiment may comprise a cup holder with a central reverse forming feature (domed former) and the stretch punch may have a corresponding recess in its central portion. Stretching in the method of this embodiment is typically in two stages but in a single movement of the press. By stretching both the inner and outer portions of the dome in that single movement, this may increase the risk of splitting. Alternatively, it is preferable to use an apparatus with an independently driven component as reverse forming tool and central dome former rather than being incorporated with the cup holder. The method thus includes advancing a central dome former and stretch forming the inverted dome after first stretching and therefore completion of the outer portion of the dome.

According to a further aspect of the present invention, there is provided an apparatus for manufacture of a metal can body from a cup formed of metal sheet, in which the cup has a sidewall and an integral base, the apparatus comprising: i) a cup holder on which a cup is mountable; ii) a first clamp ring which is adapted to clamp a first annular region on the base to define a first enclosed portion which includes a central part of the base; iii) a first stretch punch which is adapted to deform and stretch at least some of that central part of the base to thereby increase its surface area and reduce the thickness of the base; iv) a second clamp ring which is adapted to clamp a second annular region on the base and defines a second enclosed portion having a different area from that of the first enclosed portion but including the stretched central part from the first stretching operation; in which both clamps are adapted to restrict or prevent metal flow from radially outside respective clamped regions into the enclosed portions during stretching; v) a second stretch punch which is adapted to deform and stretch at least some of the second enclosed portion to reduce the thickness of the base further, and vi) means for drawing the cup into a can body by pulling and transferring outwardly material of the stretched and thinned base.

The apparatus of the present invention has features which are provided for carrying out corresponding steps of the alternative stretching methods as described above. Thus, in one embodiment, the second stretch punch includes a complementary support surface for supporting the stretched part of the enclosed portion.

In another embodiment, the second clamp ring restrains material radially outside the central portion of the base from flow into the enclosed portion and the second stretch tool contacts the stretched central part from the first stretching operation for further stretching of that part.

In yet another embodiment, the stretch punch has a central recess and the apparatus includes a central protrusion on the cup holder, which, in use, contacts the central portion of the cup so as to reverse stretch that central portion.

In this embodiment, both stretch operations are carried out using the same apparatus and in a single action. Alternatively, the central protrusion of the cup holder comprises a double action press with an independent second punch which acts as a reverse forming tool and central dome former and the stretch punch has a profile which is adapted to form the larger outer dome whereby, in use, the central portion of the cup is formed in a separate operation, during or after completion of formation of the larger outer dome.

BRIEF DESCRIPTION OF DRAWINGS

The invention will now be described, by way of example only, with reference to the drawings, in which.

DESCRIPTION OF EMBODIMENTS

Figure 1:
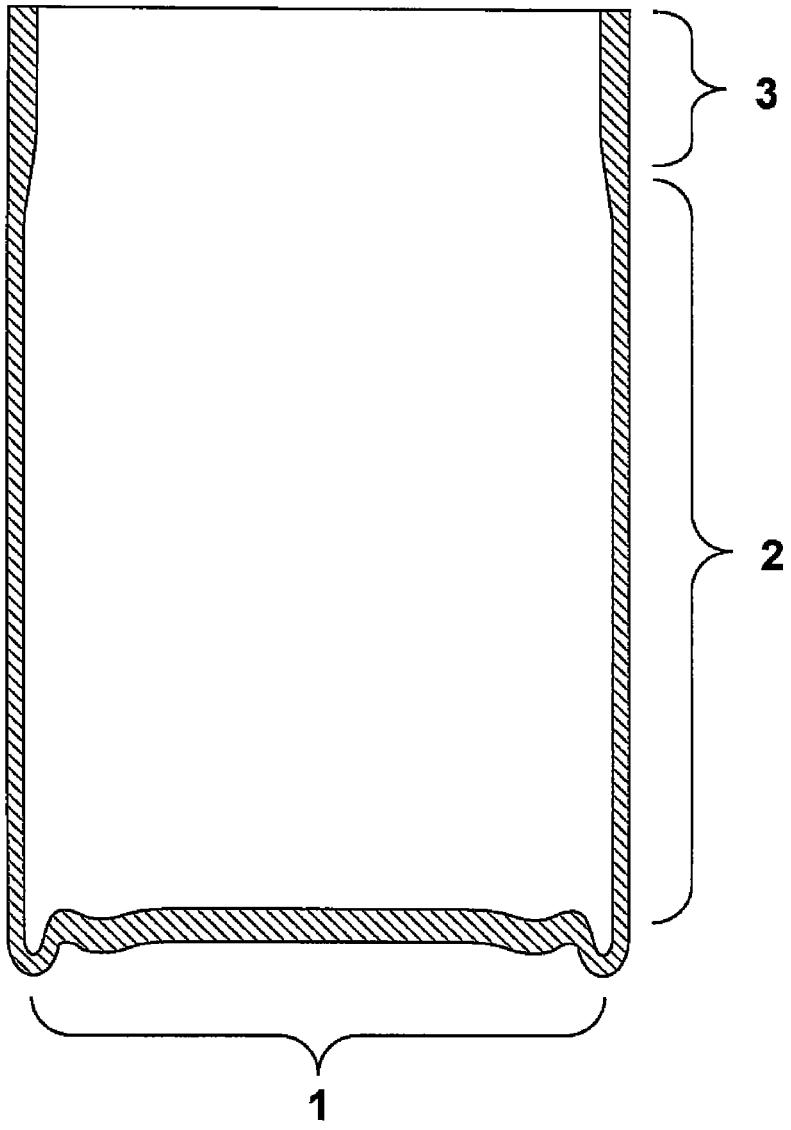
FIG. 1 is a side view of a container body of the prior art and resulting from a conventional DWI process.

FIG. 1 shows the distribution of material in the base 1 and sidewall 2 of a container body of the prior art resulting from a conventional DWI process.

An initial "cupping" operation is carried out as described in detail in unpublished patent application PCT/EP11/051666. The cupping operation can be summarised as follows:

A cupping press (also known as a "cupper") has a draw pad and a draw die. A draw punch is co-axial with the draw die, and a circumferential cutting element surrounds the draw pad. In use, a flat section of metal sheet is held in position between opposing surfaces of the draw pad and the draw die. Steel tin-plate (Temper 4) with an ingoing gauge thickness ($t_{in\text{-}going}$) of 0.280 mm has been used for the metal sheet. Although neither the invention of PCT/EP11/051666 nor the present invention is limited to particular gauges or metals and even polymer-coated metal could be used, it is considered essential in the metal packaging industry for the gauge to be kept as low as possible, typically less than 0.35 mm for single reduced steel. A disc is cut from the metal sheet to form a circular planar blank.

The cupper forms a cup profile from the blank by progressively drawing the planar blank against the forming surface of a draw die. The cup thus formed has a sidewall and integral base. The wall thickness of the cup is essentially unchanged from that of the ingoing gauge of the blank, i.e. negligible stretching or thinning should have occurred. The cup that results from this initial drawing operation was referred to in PCT/EP11/051666, and will also be referred to in this application as the "first stage cup".

Figure 2A:
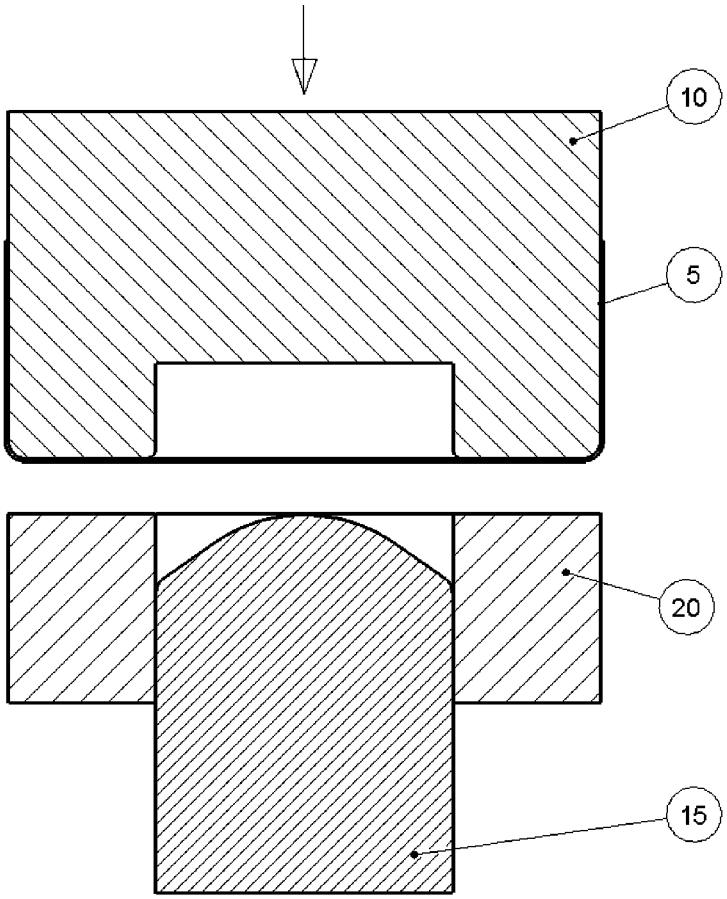
FIG. 2 is a schematic side view of a first embodiment of the invention showing first and second operations (FIGS. 2*b* and 2*c* respectively) of a two stage process.

In a first embodiment of the present invention, the first stage tooling comprises, as shown in FIG. 2*a*, a cup holder 10, on which is mounted a first stage cup 5. The lower tooling shown in FIG. 2*a* comprises a clamp ring 20 and stretch punch 15.

Figure 2B:
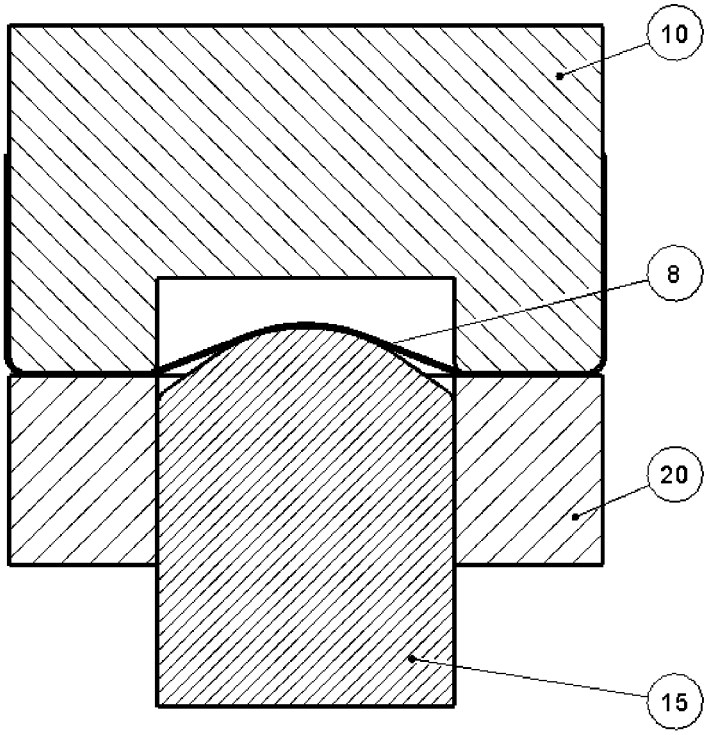

In the first operation, the cup holder 10 enters the cup 5 and advances in the direction of the arrow to clamp the outer annulus of the cup base against the clamp ring 20. The cup holder 10 continues to advance with the clamp ring 20 moving the cup down over the stationary stretch punch 15. FIG. 2*b* shows the position of the tools at the end of the first operation. The enclosed area within the clamp ring 20 corresponds to the central portion of the cup face so that relative movement between the cup holder, and cup, and the stretch punch leads to stretching of only the central portion of the cup face into a domed profile.

FIG. 2*a* is a schematic side view of an embodiment of a first stage tooling.

The cup is removed from the cup holder of the first operation tooling and placed on a different holder for the second operation. The two stages are at completely separate tooling stations.

Figure 2C:
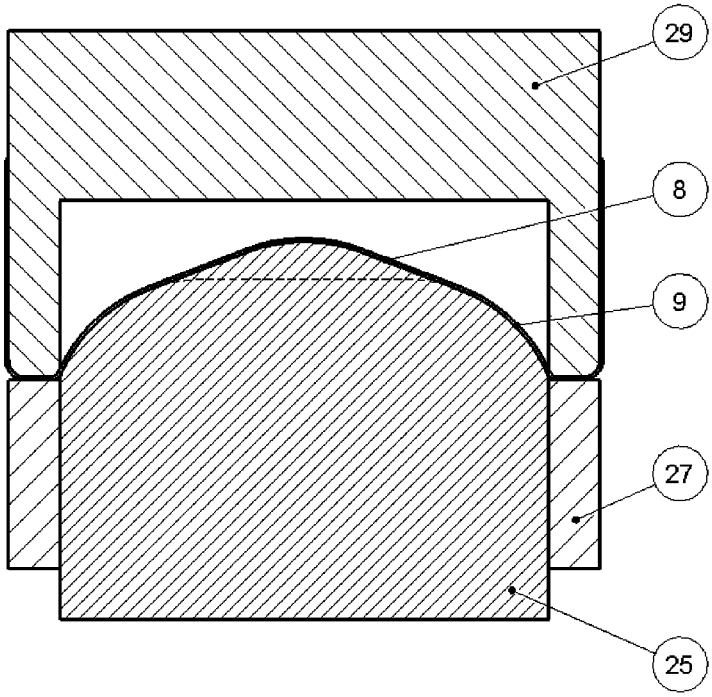

Second stage tooling used for a second stretch operation is shown in FIG. 2*c*. The second operation tools are similar to those of the first operation with the stretch punch 25 having a larger diameter and deeper profile. The cup with stretched inner base, i.e. dome 8, is mounted on a second cup holder 29 and clamped against larger internal diameter clamp ring 27. In the example of FIG. 2*c*, the central portion of the second operation stretch punch 25 matches the profile of the first operation punch 15, although matching of profiles is not essential, as shown by the dashed line in FIG. 2*c*. The central punch portion supports the dome 8 formed in the first operation cup whilst the outer portion 9 of a second operation dome is formed. Second stretching is carried out as in the first operation.

Figure 3A:
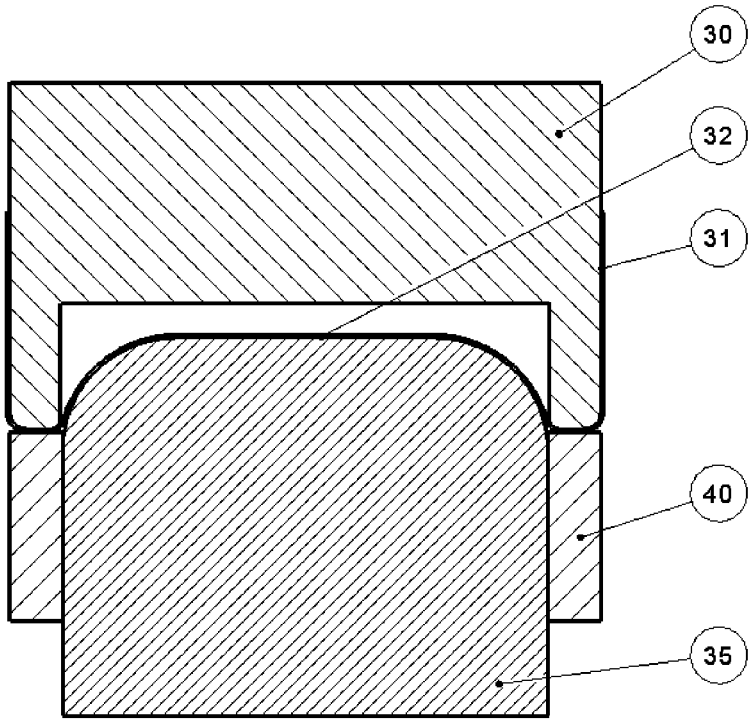
FIG. 3 is a schematic side view of a second embodiment of the invention showing first and second operations (FIGS. 3*a* and 3*c* respectively) of a two stage process.
Figure 3B:
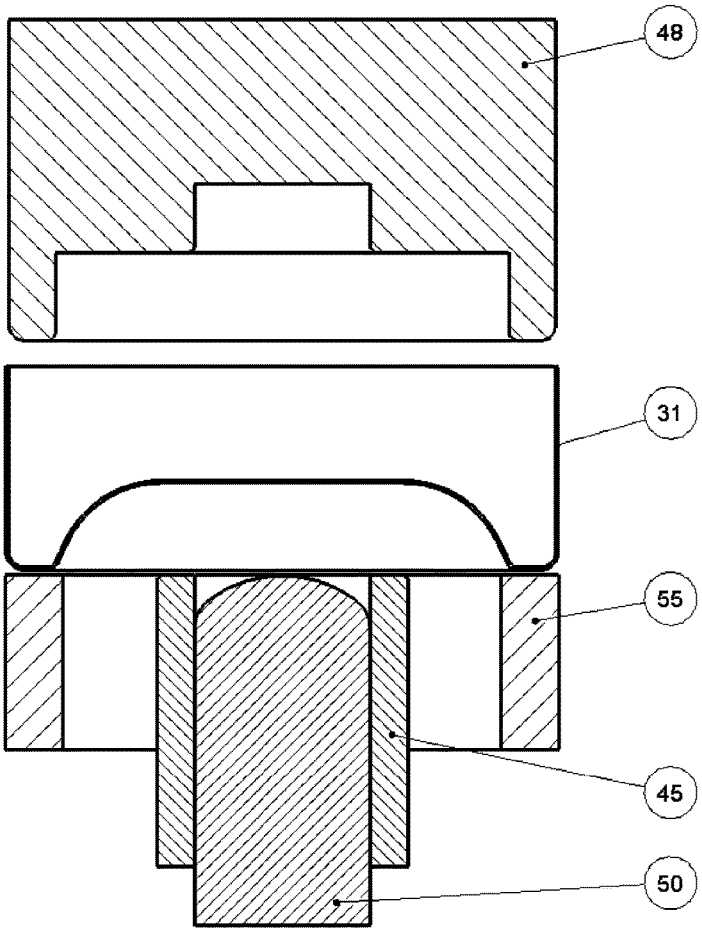
Figure 3C:
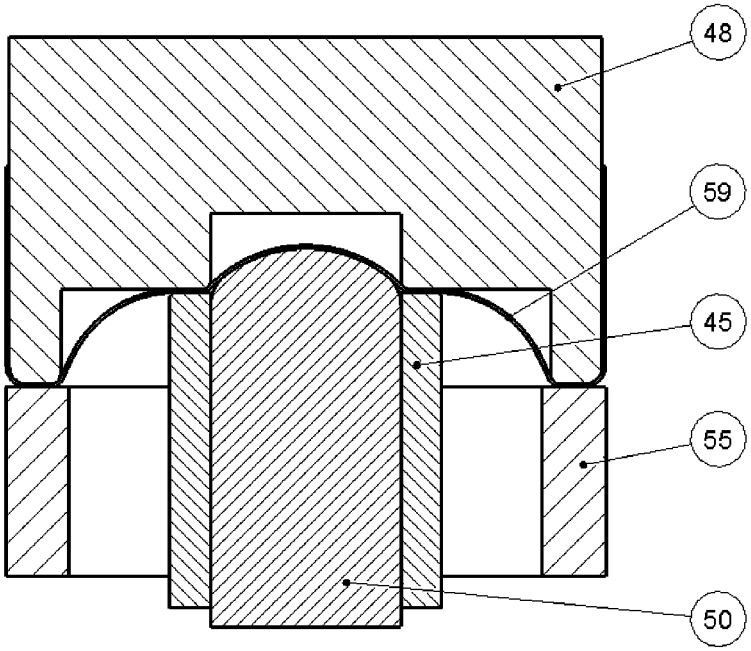

FIG. 3*b* is a schematic side view of the second operation shown in FIG. 3*c* at a start of an operation;

In this embodiment, in contrast with the known single stage stretching of the unpublished prior art, i.e. PCT/EP11/051666, the first stretching operation works specifically on the central portion of the cup. As a result there is a better opportunity to stretch this central region, compared with the current single operation process. In other words, the total chord length of the stretched base following the two stages and two operations is increased over that achieved by the single operation stretching of PCT/EP11/051666.

A second embodiment (method/apparatus) of the present invention using two stages and two operations is shown in FIG. 3. The first operation tooling of FIG. 3*a* includes a cup holder 30 for holding the cup 31 as before but with a first stretch punch 35 and a clamp ring 40 which have larger diameters (internal in the case of the clamp ring) than those of the apparatus of FIG. 2*a* so that in the first operation the punch stretches the whole of the base of the cup 31. The profile of punch 35 has a flat central portion 32 so that the first operation predominantly stretches the outer portion of the domed profile.

FIG. 3*b* shows the second operation tooling at the start of the operation. This includes an inboard clamp ring 45 and second stretch punch 50, which is of smaller diameter than the first operation punch 35.

Initially, the lifter pad 55 is up in line with the clamp ring 45 and stretch punch 50. The stretched cup 31 from the first operation stands on the lifter pad 55. The second operation cup holder 48 enters the first operation cup and advances to the base of the cup. As the cup holder 48 continues to advance, it pushes down the lifter pad 55 until the central portion of the cup's dome is clamped against the clamp ring 45. Continued advancement of the cup holder 48, clamp ring 45 and lifter pad 55 stretches the central portion of the dome over the second stretch punch 50 until the cup is stretched to its final form 59, as shown in FIG. 3*c*.

Whilst this method requires two operations, these actions of stretching the inner and outer portions of the cup base are completely independent of each other.

Figure 4:
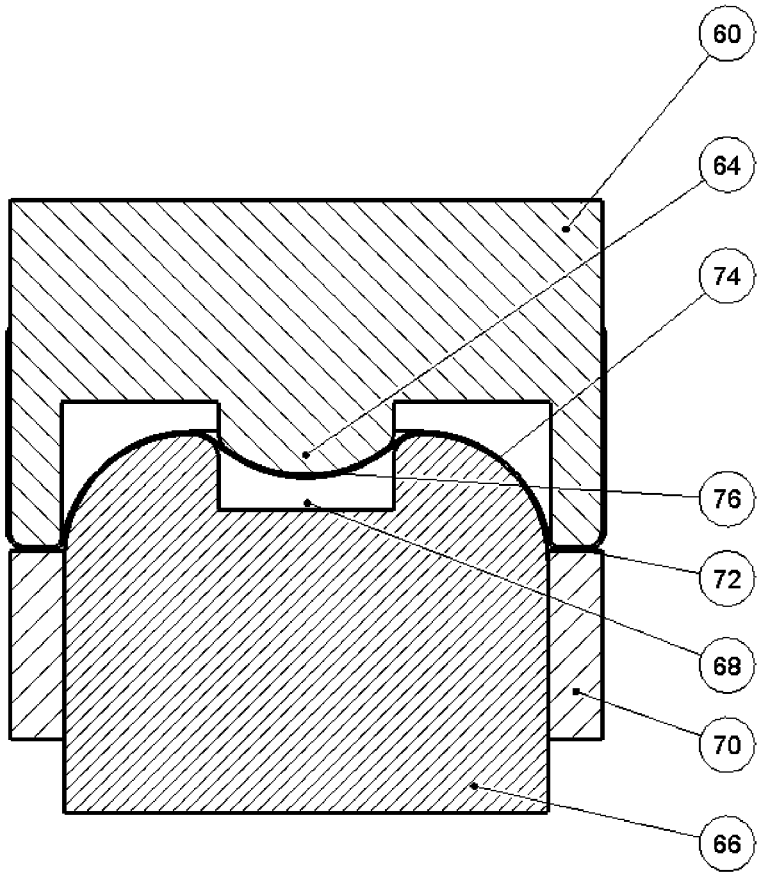
FIG. 4 is a schematic side view of a third embodiment of the invention showing two stages with a single press movement.

A third embodiment of the invention, which combines the two stage stretching in a single movement of the press, is shown in FIG. 4. The tooling for this method is similar to that of the first operation for the second embodiment shown in FIG. 3*a*, except that the cup holder 60 of FIG. 4 has a central reverse forming tool 64 and the stretch punch 66 has a corresponding recess 68 in its central portion.

In use, the cup holder 60 enters the cup and advances to clamp the outer annulus 72 of the cup base against the clamp ring 70. The cup holder 60 continues to advance with the clamp ring (70), thereby moving the cup down over the stretch punch 66 and starting to stretch form an outer portion 74 of the base into a dome shape.

The reverse forming tool (domed former) 64 on the cup holder then contacts the centre of the cup and as the tooling advances further, the cup base stretches so that the remainder of outer portion 74 of the dome and the reverse formed feature (inverted part) 76 are formed at the same time.

Whilst it is advantageous that the two stages of stretching are carried out in a single movement of the press, by stretching both the outer and inner portions of the dome in that single movement, this may increase the risk of splitting of the cup base. The double action press and tooling of FIG. 5 provides a solution to this.

Figure 5:
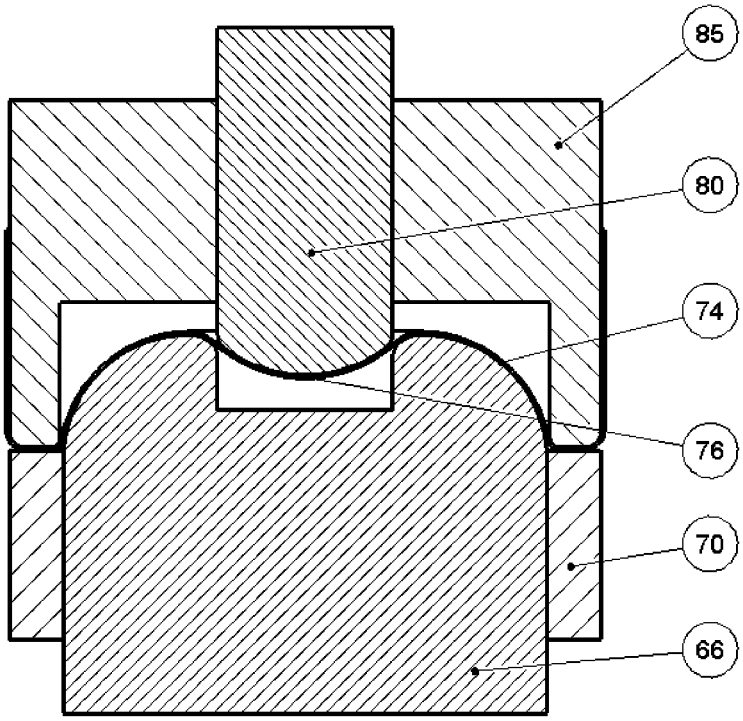
FIG. 5 is a schematic side view similar to that of FIG. 4 but having a double action press.

In FIG. 5, the reverse forming tool 80 is an independently driven component rather than being incorporated in the cup holder 85. In operation, the reverse forming tool 80 can be advanced to stretch form the inverted dome 76 during or after completion of stretching of the outer portion 74 of the dome by the stretch punch 66. This double acting press has the benefits of carrying out the stretching in two independent stages and reducing the risk of splitting.

An example of a drawing operation which causes the stretched and thinned material of the base of any of the above embodiments to be progressively pulled out and transferred from the base into a reduced diameter sidewall is described in unpublished patent application PCT/EP11/051666 with reference to FIG. 10 of that application. This drawing operation has the effect of flattening the stretched regions of the base.

The invention has been described above by way of different examples only and changes may be made within the scope of the invention, as defined by the claims.

REFERENCE SIGNS LIST

FIG. 1
1 can base
2 can lower sidewall
3 can upper sidewall
FIG. 2
5 first stage cup (unformed)
8 $1^{st}$ op dome
9 outer portion of $2^{nd}$ op dome
10 $1^{st}$ op cup holder
15 $1^{st}$ op stretch punch
20 $1^{st}$ op clamp ring
25 $2^{nd}$ op stretch punch
27 $2^{nd}$ op clamp ring
29 $2^{nd}$ op cup holder
FIG. 3
30 $1^{st}$ op cup holder|
31 $1^{st}$ op cup
32 central portion of punch
35 $1^{st}$ op stretch punch
40 $1^{st}$ op clamp ring
45 $2^{nd}$ op clamp ring
48 $2^{nd}$ op cup holder
50 $2^{nd}$ op stretch punch
55 lifter pad
59 $2^{nd}$ op cup
FIGS. 4 And 5
60 cup holder and upper tool
64 reverse forming feature (central dome) on upper tool
66 lower punch tool
68 recess in lower punch tool
70 clamp ring
72 outer dome annulus
74 outer portion of dome
76 inverted dome (reverse forming feature)
80 independent tool for reverse forming (central dome former)
85 cup holder

The invention claimed is:

1. An apparatus for manufacture of a metal can body from a cup formed of metal sheet, in which the cup has a sidewall and an integral base, the apparatus comprising:

i) a cup holder on which a cup is mountable;

ii) a first clamp ring which is adapted to clamp a first annular region on the base by contacting a top portion of the annular region with a first annular projection and contacting a bottom portion of the annular region with a second annular projection to define a first enclosed portion which includes a central part of the base;

iii) a first stretch punch which is adapted to deform and stretch at least some of the central part of the base to thereby increase its surface area and reduce the thickness of the base;

iv) a second clamp ring which is adapted to clamp a second annular region on the base and defines a second enclosed portion having a larger area from that of the first enclosed portion and including the central part; in which the first clamp ring and the second claim ring are adapted to restrict metal flow from radially outside respective clamped regions into the first enclosed portion and the second enclosed portion, respectively, during stretching;

v) a second stretch punch which is adapted to deform and stretch at least some of the second enclosed portion to reduce the thickness of the base further, and vi) drawing tooling for drawing the cup into a can body by pulling and transferring outwardly material of the stretched and thinned base.

2. An apparatus according to claim 1, in which the second stretch punch includes a complementary support surface for supporting the stretched part of the first enclosed portion.

3. An apparatus according to claim 1, in which a central portion of the first stretch punch is substantially flat.

4. An apparatus according to claim 1, in which the second clamp ring restrains material radially outside the central portion of the base from flow into the enclosed portion and the second stretch punch contacts and further stretches the at least some of that central part of the base stretched by the first stretch punch.

5. An apparatus according to claim 4, comprising a second stage cup holder, and the second stretch punch acts as a central dome former and the first stage stretch punch has a profile which is adapted to form the larger outer dome whereby, in use, the central portion of the cup is formed in a separate operation, during or after completion of formation of the larger outer dome.

6. A method for manufacture of a metal can body, the method comprising the following stages:

i) a first stretching stage comprising:

on a cup having a sidewall and an integral base, the cup being formed of metal sheet, clamping an annular region on the base to define a first enclosed portion which includes a central part of the base, the clamping including contacting a top portion of the annular region with a first annular projection and contacting a bottom portion of the annular region with a second annular projection, and deforming and stretching at least some of the first enclosed portion to thereby increase the surface area and reduce the thickness of the base;

ii) a second stretching stage comprising:

stretching a second enclosed portion of the base, the second enclosed portion having a larger area than the first enclosed portion, the second area including the central part of the base;

in which the step of clamping the annular region of the base is adapted to restrict metal flow from radially outside the annular region into the first enclosed portion during stretching; and iii) a drawing operation comprising drawing the cup into a can body by pulling and transferring material outwardly from the thinned base.

7. A method according to claim 6, in which the annular region is a first annular region and the first and second stretching stages are carried out in two independent press operations, in which:

i) the first stretching stage is a first press operation;

ii) the second stretching stage is a second press operation, and comprises:

clamping a second annular region of the base to define the second enclosed portion, the second enclosed portion defining an area that is different from the first enclosed portion; and deforming and stretching at least some of the second enclosed portion, to reduce the thickness of the base still further;

iii) the steps of clamping the first annular region of the base and clamping the second annular region of the base are each adapted to restrict metal flow from radially outside the first annular region and the second annular region, respectively, into the first and second enclosed portions during the first stretching stage and the second stretching stage, respectively.

8. A method according to claim 7, in which the second stretching stage further includes supporting the stretched part of the second enclosed portion.

9. A method according to claim 7, in which the second enclosed portion comprises substantially only a central part of the base.

10. A method according to claim 7, in which the second stretching stage comprises reverse stretching of the central part of the base.

11. The method according to claim 6, in which the first enclosed portion is the same area as the second enclosed portion.

12. The method according to claim 6, in which the first enclosed portion is a different area than the second enclosed portion.

* * * * *